US005884780A

United States Patent [19]

Cho

[11] Patent Number: 5,884,780

[45] Date of Patent: Mar. 23, 1999

[54] GOLF CLUB ORGANIZING STRUCTURE

[76] Inventor: Kwang Hyun Cho, 3249 Hawkwood Rd., Diamond Bar, Calif. 91765

[21] Appl. No.: 742,199

[22] Filed: Oct. 31, 1996

[51] Int. Cl.[6] ..... A47F 7/00

[52] U.S. Cl. ..... 211/70.2

[58] Field of Search ..... 211/70.2, 60.1; 206/315.6; 473/282

[56] References Cited

U.S. PATENT DOCUMENTS

| | | | |
|---|---|---|---|
| 1,719,360 | 7/1929 | Deike | 211/70.2 X |
| 2,513,020 | 6/1950 | Haney | 211/70.2 X |
| 2,520,226 | 8/1950 | Smith | 211/70.2 X |
| 3,154,314 | 10/1964 | McCune | 211/70.22 |
| 4,960,212 | 10/1990 | Wu | 211/70.2 |

*Primary Examiner*—Alvin C. Chin-Shue
*Assistant Examiner*—Sarah Purol
*Attorney, Agent, or Firm*—John K. Park; John K. Park & Associates

[57] ABSTRACT

A golf club organizing structure intended to be used in conjunction with a conventional golf club bag wherein said structure has a plurality of apertures, each aperture accommodating a singularity of golf clubs, wherein each of said plurality of apertures are cleaved to accommodate the heads of each golf club. Because said heads of said plurality of golf clubs are accommodated by said cleaves, said golf clubs are aligned in an orderly manner, thereby facilitating the selection of the proper golf club as well as providing a visually pleasing organized golf club bag.

3 Claims, 1 Drawing Sheet

GOLF CLUB ORGANIZING STRUCTURE

BACKGROUND OF THE INVENTION

1. Field of the Invention

The present invention relates generally to equipment used in the sport of golf, and specifically to a golf bag with a distinct structure which arranges golf clubs within said golf bag in an orderly manner, thereby facilitating the selection of the proper club.

2. Description of the Prior Art

The prior art in the field of golf equipment teach several variations of golf bags and golf club organizing means. However, the prior art does not teach a golf bag with a structure as disclosed by the present invention.

Accordingly, it is a primary object of the present invention to provide a means for conveniently arranging a plurality of golf clubs, wherein said means for conveniently arranging a plurality of golf clubs is used in conjunction with a conventional golf bag to properly store golf equipment.

Yet another object of the present invention is to provide a means for conveniently arranging a plurality of golf clubs which has a covering means to protect said plurality of golf clubs from moisture and inadvertent collisions.

SUMMARY OF THE INVENTION

The present invention is a golf club arranging structure intended to be used in conjunction with a conventional golf club bag. The upper end of a conventional golf club bag has an apertured surface which provides access to a cavity within said golf bag which accommodates a plurality of golf clubs, a singularity of apertures accommodating a singularity of golf clubs. The apertured surface of a conventional golf bag has no organizational means, and the plurality of golf clubs are usually in disarray, facing different directions and contributing to a golfer's frustration by preventing said golfer to locate a proper club in a timely fashion. In addition, the plurality of golf clubs in a conventional golf bag is not organized in an orderly manner and thus causes the bearer of the bag to appear unkempt and unprofessional. The present invention provides a structure which arranges a plurality of golf clubs, wherein the structure is positioned in substitution of the apertured surface in the aforementioned conventional golf bag. The structure has a plurality of apertures, each aperture accommodating a singularity of golf clubs. The plurality of apertures are arranged in a manner which orients the plurality of golf clubs in the same direction, thereby allowing a golfer to expeditiously locate the required golf club, as well as allowing the golfer to look his or her best on the course.

BRIEF DESCRIPTION OF THE DRAWINGS

For a better understanding of the principle and nature of the present invention, reference should be made to the following detailed description taken in connection with the accompanying drawings in which.

DETAILED DESCRIPTION OF THE PREFERRED EMBODIMENT

Figure 1:
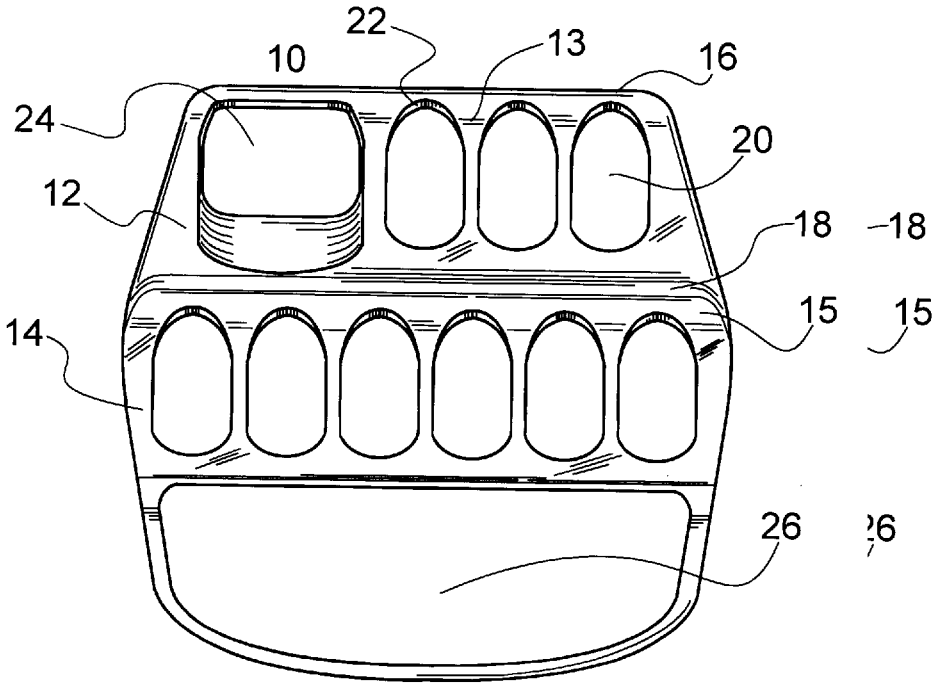
FIG. 1 is a top plan view of the present invention.

Referring to FIG. 1, the present invention comprises an apertured structure 10, wherein said apertured structure 10 has apertures of different configurations to accommodate different clubs and accessories. The plurality of apertures 20 are disposed on said apertured structure 10 in rank, thereby organizing the golf clubs which are stored therein in an orderly manner.

Figure 2:
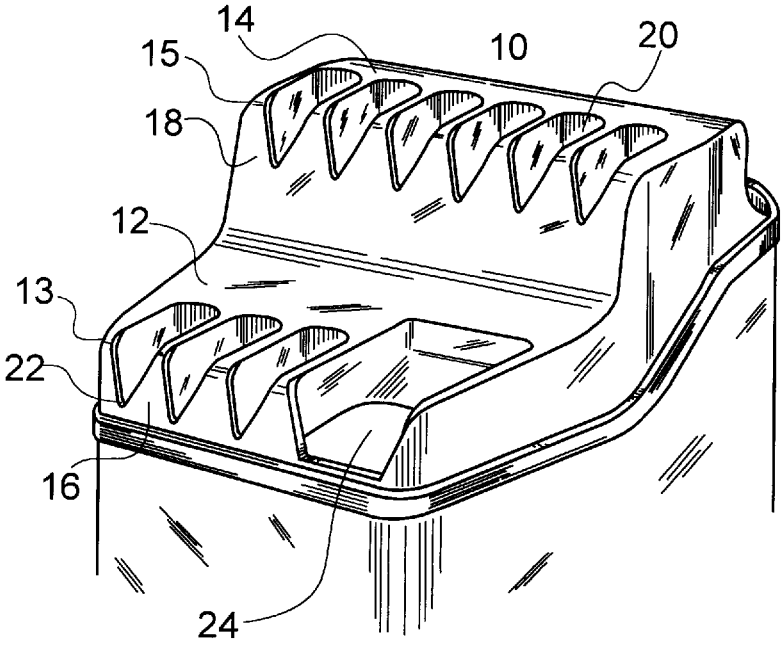
FIG. 2 is a perspective view of the present invention.

Referring to FIG. 1 and FIG. 2, said apertured structure 10 has two horizontal levels, a lower horizontal level 12 and an upper horizontal level 14, each horizontal level having a plurality of apertures 20 disposed thereon. Each aperture 20 on said lower horizontal level 12 is disposed alongside the edge 13 of said lower horizontal level 12, and each aperture 20 on said upper horizontal level 14 is disposed alongside the edge 15 of said upper horizontal level 14. Said edge 13 adjoins and links said lower horizontal level 12 and a lower perpendicular surface 16, and said edge 15 adjoins and links said upper horizontal level 14 and an upper perpendicular surface 18. Each of said apertures 20 disposed on said lower horizontal level 12 extend through said lower perpendicular surface 16, resulting in a plurality of apertures 20 wherein each aperture 20 cleaves said lower perpendicular surface 16. Likewise, each of said apertures 20 disposed on said upper horizontal level 14 extend through said upper perpendicular surface 18, resulting in a plurality of apertures 20 wherein each aperture 20 cleaves said upper perpendicular surface 18.

The cleave 22 of each aperture 20 accommodates a head of a golf club. Therefore, when a plurality of golf clubs are inserted into said plurality of apertures 20, each respective head of said plurality of golf clubs are received into each respective cleave 22 of each aperture 20, and consequently said plurality of golf clubs are aligned in the same direction.

In addition, because golf club putters have a different shape than golf club irons, a putter aperture 24 is also provided by the present invention. The putter aperture 24 is identical to a normal aperture 20, aside from the fact that it is larger to accommodate the larger and longer head of a golf club putter. A utility aperture 26 which accommodates additional golf equipment is also provided by the present invention.

Although the present invention has been described as having only two horizontal levels, an upper horizontal level 14 and a lower horizontal level 12, alternate embodiments may have a plurality of horizontal levels which would consequently accommodate an increased amount of golf clubs and golf equipment.

What is claimed as being new and therefore desired to be protected by Letter Patent of the United States is as follows:

1. A golf club organizing structure comprising an upper and a lower horizontal level, wherein a plurality of apertures are disposed on said upper and said lower horizontal levels, said upper and said lower horizontal levels having a first and a second edge;

a) A lower perpendicular surface adjoined to first edge of said lower horizontal level, and an upper perpendicular surface adjoined to first edge of said upper horizontal level, said lower perpendicular surface and said upper perpendicular surface having an upper and lower end, wherein said lower end of said upper perpendicular surface adjoined to second edge of said lower horizontal level;

b) said plurality of apertures disposed on said lower horizontal level extending to said first edge of said lower horizontal level, wherein each of said plurality of apertures cleaves into said upper end of said lower perpendicular surface; and c) said plurality of apertures disposed on said upper horizontal level extending to said first edge of said upper horizontal level, wherein each of said plurality of apertures cleaves into said upper end of said upper perpendicular surface.

2. A golf club organizing structure as mentioned in claim 1, wherein a plurality of apertures of different sizes are disposed on said upper and lower horizontal levels to accommodate golf clubs of various sizes.

3. A golf club organizing structure as mentioned in claim 2, wherein a plurality of horizontal levels are disposed on said structure to accommodate an increased amount of golf clubs.

* * * * *